United States Patent [19]

Nakahara

[11] 4,321,223

[45] Mar. 23, 1982

[54] PROCESS FOR PLACING CONCRETE THROUGH HIGH HEAD

[76] Inventor: Yasushi Nakahara, 546-19, Higashi Asakawa-cho, Hachioji-shi, Tokyo, Japan

[21] Appl. No.: 89,862

[22] Filed: Oct. 31, 1979

[51] Int. Cl.[3] ..... E04B 1/16

[52] U.S. Cl. ..... 264/32; 264/333

[58] Field of Search ..... 264/32, 333

[56] References Cited

U.S. PATENT DOCUMENTS 2,414,310 1/1947 Laird ..... 264/32

3,492,395 1/1970 Breitfuss ..... 264/32

3,619,431 11/1971 Weaver ..... 264/32

*Primary Examiner*—John A. Parrish

*Attorney, Agent, or Firm*—Oblon, Fisher, Spivak, McClelland & Maier

[57] ABSTRACT

A process for placing concrete in very deep vertical shafts or the like, by evacuating a substantially vertically disposed flexible hose and then intermittently feeding concrete material through the hose while keeping the hose airtight from the top thereof, so as to avoid separation of concrete ingredients during travelling through a high head.

1 Claim, 11 Drawing Figures

PROCESS FOR PLACING CONCRETE THROUGH HIGH HEAD

BACKGROUND OF THE INVENTION

1. Field of the Invention

This invention relates to a process for placing concrete through a high head, which process is particularly suitable for efficiently and safely placing concrete onto the surface of a substantially vertical structure in the ground at a substantial depth below the ground surface, such as in the gap between a pressure pipe and surrounding earth for an underground hydraulic power plant, vertical shafts for gates, vertical shafts for elevators and the like, without causing any separation of cement and aggregates.

2. Description of the Prior Art

Heretofore, in order to place concrete on the surface of a vertical shaft, steel pipes or extensible chutes have been used for feeding concrete as long as the depth of the vertical shaft is 10 to 20 meters. If the vertical shaft is deeper than 10 to 20 meters, materials of the concrete tend to be separated while being fed through such a high head and the impact of the dropping of the concrete tends to cause various hazards, so that buckets with a capacity of 1 to 3 cubic meters are vertically moved by a crane installed at the top of the vertical shaft for conveying the concrete down to a hopper located at suitable portion of the shaft, and the concrete is then placed to desired portions through a chute connected to the lower end of the hopper.

When the span of the vertical travel of the bucket becomes 100 to 200 meters, the vertical travelling speed of the bucket is restricted for ensuring the safety of the operation. As a result, the speed of placing the concrete is reduced to 5 to 10 $m^3$/hour or less, and the efficiency of construction is considerably lowered. Besides, when a worker stays at the place of depositing the concrete for compacting, he is exposed to the risk of being hit by concrete particles or blocks which are separated from the bucket moving above him and dropping downwards. The process of concrete placing with vertically moving buckets has a further difficulty in that, due to the use of a crane installed at the top of the vertical shaft, it is very difficult to work in the space above the crane and to install any temporary structures thereabove during the concrete placing.

SUMMARY OF THE INVENTION

Therefore, an object of the present invention is to obviate the aforesaid difficulties of conventional processes by providing an improved process for placing concrete through a high head. With the process according to the present invention, a flexible hose is extended downwardly from the top of a high head, and a lump or slug of liquid material, such as water, mortar, or concrete, is put into the hose from the top thereof while airtightly closing the hose top right after putting the liquid material therein, so as to remove air from the hose for making the flexible hose flat, and then concrete material is fed downwards through the flexible hose at intervals while normally keeping the hose top closed airtightly. The concrete material thus intermittently fed down the hose drops comparatively slowly while expanding the hose, so that no separation of the ingredients of the concrete occurs. Here, "concrete material" means various cement-containing materials to be placed on earth or structure surfaces, such as mortar, cement milk, concrete mixture, and the like.

A device for placing concrete through a high head according to the present invention includes a flexible hose extending downwardly from top of a high head, a hopper airtightly connected to the top end of the hose, and a valve for selectively closing communication between the hopper and the hose, the hose being adapted to be flattened upon removal of air therefrom.

With a preferred embodiment of the invention, the hose extending downwardly from the top of the high head includes a plurality of hose units connected in series, each of the hose units having a hose section with flanges connected to opposite ends thereof and hanging members extending between the flanges so as to bear mechanical loads on the hose section, the flanges of adjacent hose units being joined by a suitable coupling member, for instance by bolts and nuts.

With another embodiment of the present invention, a valve body is disposed in a hopper connected to the top end of a flexible hose so as to selectively engage a valve seat formed around the top end opening of the flexible hose, a pneumatic cylinder is operatively connected to a valve rod fixed to the valve body, and an electromagnetic valve is related to the pneumatic cylinder for regulating flow of compressed air to the pneumatic cylinder under the control from a control board.

With another embodiment of the present invention, the top end of the flexible hose is airtightly connected to one end of a screw feeder installed on the ground surface near the upper end of the high head, and a hopper is connected to the opposite end of the screw feeder. The screw feeder includes a screw extending through the screw feeder from the bottom of the hopper to the end connected to the hose, so as to airtightly feed the concrete material from the hopper to the hose. The intermittent feeding of the concrete material to the hose is effected by rotating the screw at intervals.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
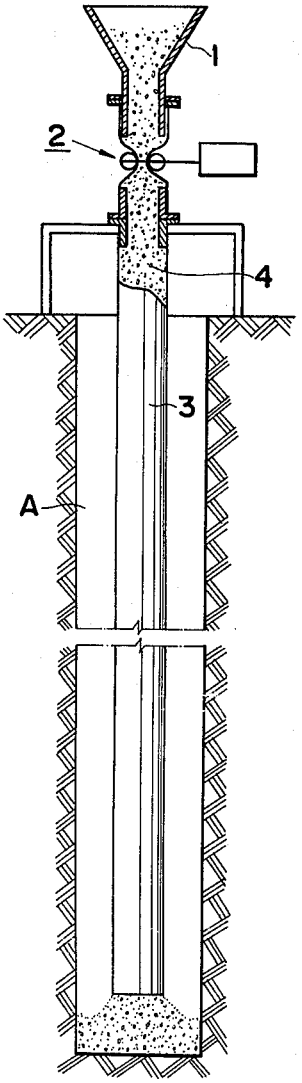
FIGS. 1 through 3 are schematic sectional views of a vertical shaft with a high head, to which the process according to the present invention is applied for placing concrete on the surface thereof.
Figure 2:
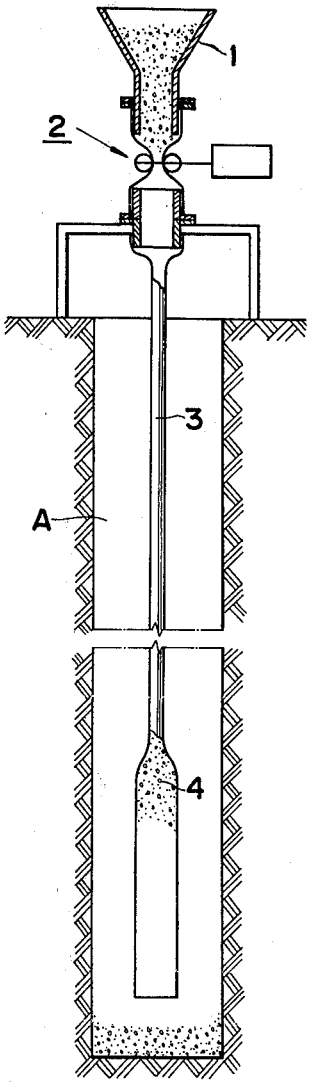
Figure 3:
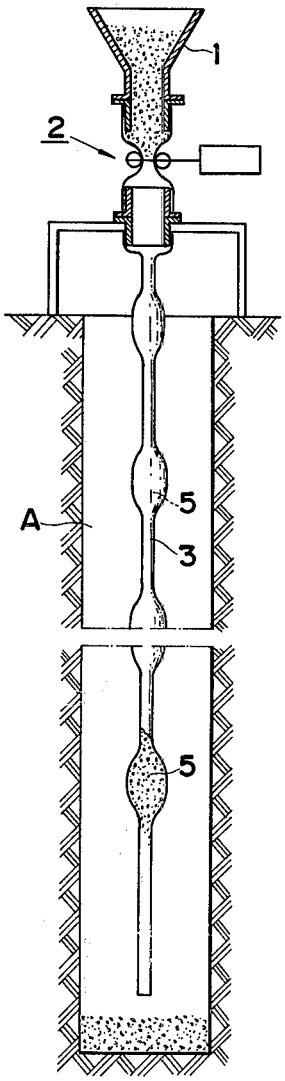

Referring to FIGS. 1 through 3 illustrating an embodiment of the present invention, a hopper 1 is installed above the top opening of a vertical shaft A and a regulating valve 2 is disposed at the bottom of the hopper for controlling the rate at which concrete material is fed. A flexible hose 3 extends downwardly from the outlet side of the valve 2 into the vertical shaft A, and the top end of the flexible hose 3 is airtightly connected to the valve 2. The flexible hose 3 is made of rubber, synthetic resin, or a woven cloth and has an airtight and flexible construction. The shape of the flexible hose 3 is preferably flat when empty. In the illustrated embodiment, the top end of the flexible hose 3 is supported by a structure installed on the ground surface. To facilitate shortening of the flexible hose 3 with progress of the placing of concrete, the hose 3 may consist of a plurality of hose units (see FIG. 4) which are connected in series by means of flanges, so that the flexible hose 3 may extend throughout the entire depth or head of the vertical shaft A at the beginning of operation, such as 100 to 200 meters in vertical direction.

In operation, a lump of liquid substance 4, such as water, mortar or concrete mixture with a comparatively high content of cement, is forced through the flexible hose 3 from the top thereof, while airtightly closing the top end of the hose 3, so as to remove the air in the flexible hose 3 through the lower end opening thereof. In the example of FIGS. 1 and 2, concrete mixture is once fed through the flexible hose 3 as such liquid substance 4, and then the valve 2 is suddenly closed airtightly for evacuating the inside of the flexible hose 3. The hose 3 is flattened upon removal of the air therefrom. Then, concrete material 5 is fed into the flexible hose 3 at intervals by operating the valve 2, as shown in FIG. 3, so as to drop the concrete material 5 intermittently through the flexible hose 3.

The interval between successive feedings of the concrete material 5 and the amount of the concrete material 5 for each feeding are selected so as to drop the concrete material 5 at a specific speed achieved by the balance of the weight of each lump of the concrete material 5 fed at one feeding and the resistance of the flexible hose 3 against expansion from the flattened condition. For instance, when the diameter of the flexible hose 3 is 15 to 30 cm and the slump value of the concrete material is 8 to 15 cm, the concrete material 5 can be fed at a rate of 40 to 60 liters per feeding at intervals of 0.5 to 2 seconds. The force necessary for the concrete material 5 to expand the hose 3 varies with the consistency (slump value) of the concrete material 5 and the material of the flexible hose 3, so that, if the slump value is smaller than 8 to 15 cm, the amount of the concrete material 5 to be fed each time of feeding may be increased to 80 to 120 liters or more; while if the slump value is larger than 8 to 15 cm, the concrete material 5 may be fed at a reduced rate of 20 to 40 liters per feeding.

With the aforesaid process according to the present invention, the net feeding speed of the concrete material at the lower end of a flexible hose through a head of 100 to 200 m can be controlled in a range of 4 to 6 m/sec, which is similar to a velocity reached at the end of a free drop across a height of 1 to 1.5 m. It has been confirmed by tests that the net rate of feeding the concrete material for the head of 100 to 200 m can be improved to 40 to 80 $m^3$/hour by the process of the present invention. Thus, the working efficiency in placing concrete is remarkably improved, as compared with the conventional bucket process. Furthermore, with the process according to the present invention, it is possible to effect other works at intermediate portions of the vertical shaft without being disturbed by the placing of concrete, and the safety of the workers is also improved.

It is noted that the application of the present invention is not restricted to the vertical shaft A, but the process of the invention can be advantageously used in placing concrete through a high head onto surfaces which are inclined relative to a vertical line.

Figure 4:
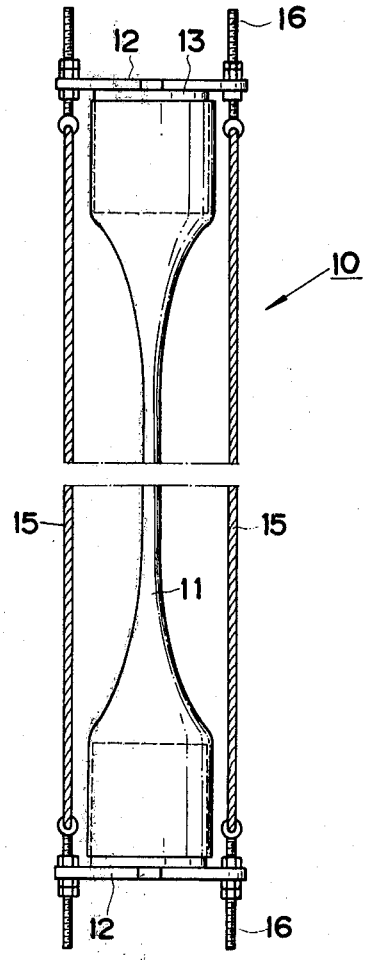
FIG. 4 is a side view of a hose unit to be used in a device according to the present invention.
Figure 5:
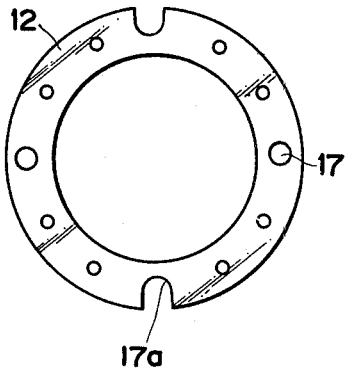
FIG. 5 is a plan view of a flange of the hose unit.
Figure 6:
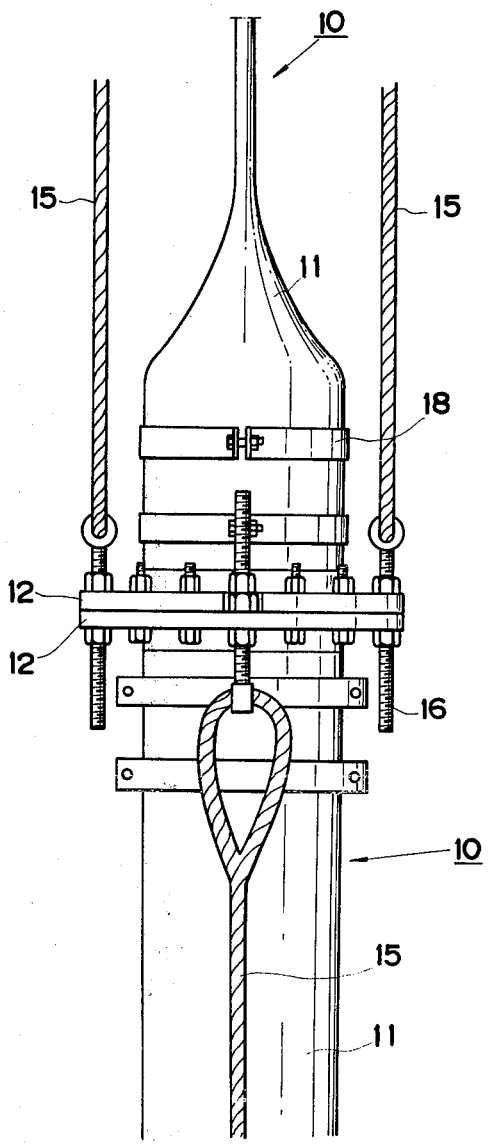
FIG. 6 is a side view of a joint portion of adjacent hose units.

With the aforesaid device of the invention, the flexible hose 3 has to bear loads of vertical direction, such as the weight of the hose itself, resistive force against the downward flow of the concrete material 5, and various impact forces. In order to reinforce the flexible hose 3 against such vertical load, it is preferable to form the flexible hose 3 by connecting a number of hose units 10, as shown in FIGS. 4 through 6. Referring to FIG. 4, a hose unit 10 has a length of about ten meters and consists of a hose section 11 made of rubber, synthetic resin, woven cloth or the like flexible material. Opposite ends of the hose section 11 are connected to a pair of flanges 12, respectively, by fitting short cylinders 13 fixed to the flanges 12 into end openings of the hose section 11, respectively. Adjacent hose units 10 can be joined by abutting the flanges 12 thereof and by connecting the thus abutted flanges 12 with suitable coupling means 14, such as bolts and nuts. The coupling means 14 should hold the flanges of the adjacent hose units 10 in position in a detachable manner.

Hanging members 15 are disposed along both longitudinal sides of the hose section 11. Each hanging member 15 is made of a wire rope, a chain, a PC steel rod, a PC stranded wire, a PC steel wire, or the like, and the opposite ends of each hanging member 15 are connected to eye bolts 16 being fixed to the flanges 12 at bolt holes 17.

Referring to FIG. 6, it is preferable to dispose the adjacent hose units 10 with a 90 degree angular displacement therebetween. The top end of the hanging member 15 of one hose unit 10 penetrates through only the top flange 12 of that hose unit 10 itself by the eye bolt 16, and the upper portion of that eye bolt 16 fits in a U-shaped notch 17*a* of the lower flange 12 of the upwardly adjacent hose unit 10. The U-shaped notch 17*a* is clearly shown in FIG. 5. Similarly, the lower end of the hanging member 15 of one hose unit 10 penetrates only through the lower flange 12 of that hose unit 10 itself by the eye bolt 16, and the lower portion of that eye bolt 16 fits in a U-shaped notch 17*a* of the upper flange 12 of the downwardly adjacent hose unit 10. Thereby, it is facilitated to connect the hose units 10 after the hanging members 15 are assembled in each hose unit 10 by fixing to the flanges 12. In FIG. 6, 18 shows fastening bands.

The hose units 10, as shown in FIGS. 4 through 6, ensure a high mechanical strength while keeping the hose section 11 highly flexible, so that such hose units 10 make it possible to build a long and strong flexible hose 3 (FIGS. 2 and 3) capable of reliably placing concrete material in a deep vertical shaft or a structure through a high head.

Figure 7:
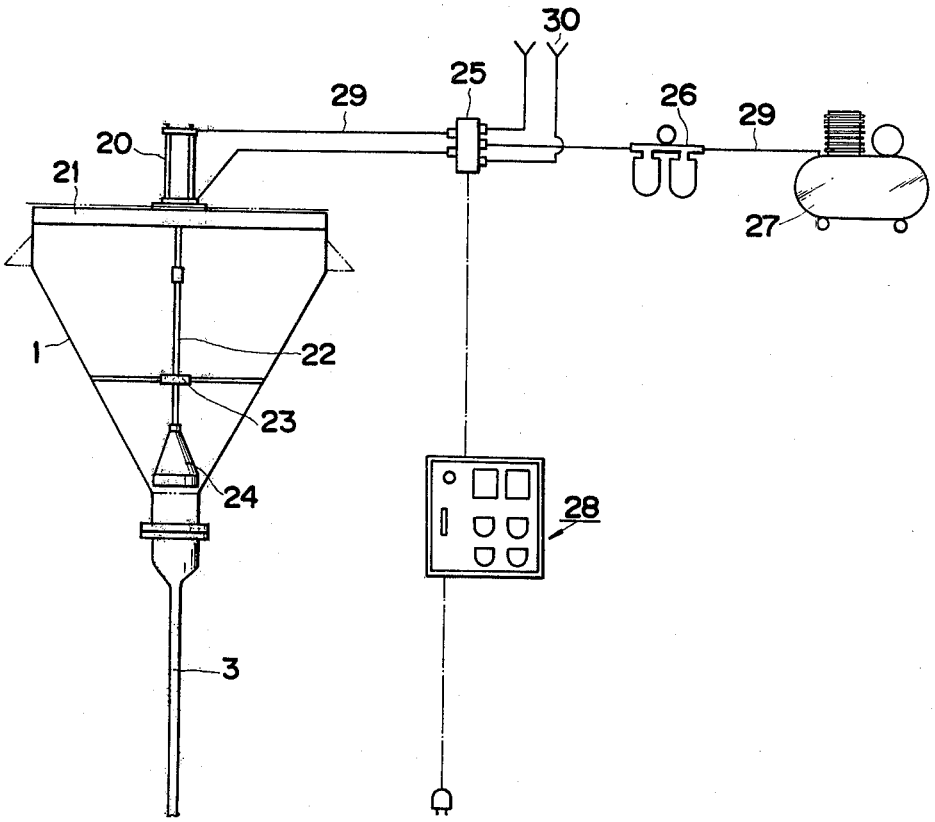
FIG. 7 is a schematic view of a pneumatically operated valve for intermittently feeding concrete material into a flexible hose.
Figure 8:
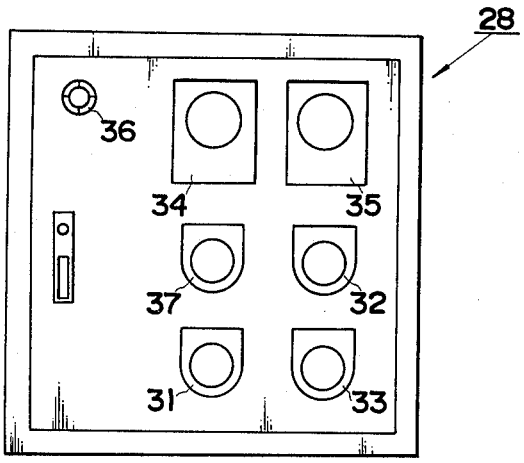
FIG. 8 is a schematic view of a control board for controlling the valve of FIG. 7.

FIGS. 7 and 8 show a valve means for intermittently feeding a specific amount of concrete material into the flexible hose 3, while maintaining the connection between the hopper 1 and the hose 3 airtight.

In FIG. 7, the upper end of the flexible hose 3 is connected to the bottom of the hopper 1, and a pneumatic cylinder 20 is mounted on a reaction frame 21 fixed to the upper portion of the hopper 1. A valve rod 22 depends from the pneumatic cylinder 20 and extends through a rod guide 23, and the lower end of the valve rod 22 is connected to a valve 24, so as to selectively open and close an opening at the bottom of the hopper 1.

The pneumatic cylinder 20, which vertically moves the valve 24 through the valve rod 22, is actuated by compressed air fed through an air filter 26, which compressed air is produced by an air compressor 27. The timing for the opening and closing actions of the pneumatic cylinder 20 is controlled by an electromagnetic valve 25 and a control board 28. In the figure, 27 represents air pipes and 30 represents air outlet openings.

Referring to FIG. 8, the control board 28 includes a selector switch 31, which provides for a choice between manual operation under supervision of operator's eyes and continuous automatic operation with a certain sequential pattern of opening and closing actions. When the manual operation is selected, the opening and closing actions of the pneumatic cylinder 20 can be actuated by operating a start button 32 and a stop button 33, respectively. When the automatic operation is selected, the timing of opening and closing the pneumatic cylinder 20 can be set by timers 34 and 35 at will within certain ranges, respectively, and the automatic operation can be started by actuating the start button 32. When the stop button 33 is actuated, the operation is terminated after bringing the pneumatic valve 20 to its closed position even when it is in an operating stroke. The operation of the pneumatic cylinder 20 can be resumed by actuating the start button 32. In FIG. 8, 36 is a power source pilot lamp indicating the availability of electric power from the power source, and 37 is an indicating lamp for showing that the valve 24 is actuated.

In operation, fluid concrete material is directly poured onto the hopper 1 before being solidified. The concrete material in the hopper 1 moves toward the flexible hose 3 in response to the opening action of the valve 24. Since it is important to prevent the air from entering into the hose 3, at least a small amount of concrete material is always kept in the hopper 1, by not allowiong the feeding of the entire concrete material in the hopper onto the flexible hose 3. As to the operation of the control board 28, the manual operation is selected at first, so as to find out proper intervals for feeding and the proper amount of concrete material to be fed at each feeding, and then the operation is transferred to the automatic operation.

With the present invention, the amount of concrete material to be forwarded at each feeding and the intervals of feedings have to be properly selected by considering physical properties of the concrete material being used for placing and the actual conditions for construction work. The control device of FIGS. 7 and 8 facilitates the selection of the proper amount of concrete material for each feeding and the proper timing of the concrete feeding by controlling the timing of the opening and closing operations of the valve. The opening and closing timing of the pneumatic cylinder can be controlled by the electromagnetic valve and the control board, especially by controlling the combination of timer settings. It is noted that the valve of FIG. 7 ensures the airtightness of the flexible hose 3.

Figure 9:
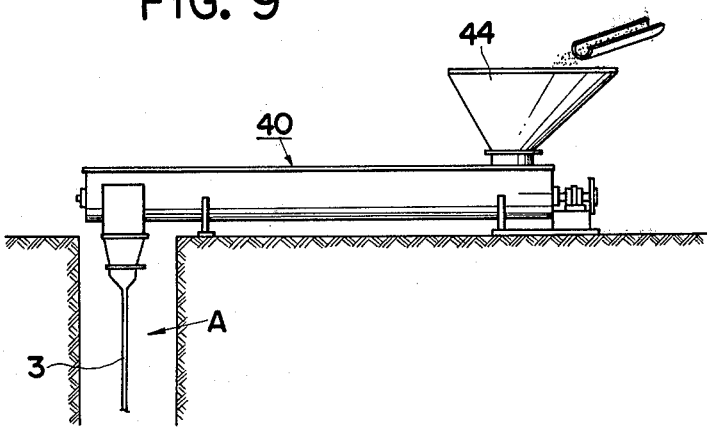
FIG. 9 is a schematic illustration of a screw feeder for intermittently feeding concrete material into a flexible hose according to the present invention.
Figure 10:
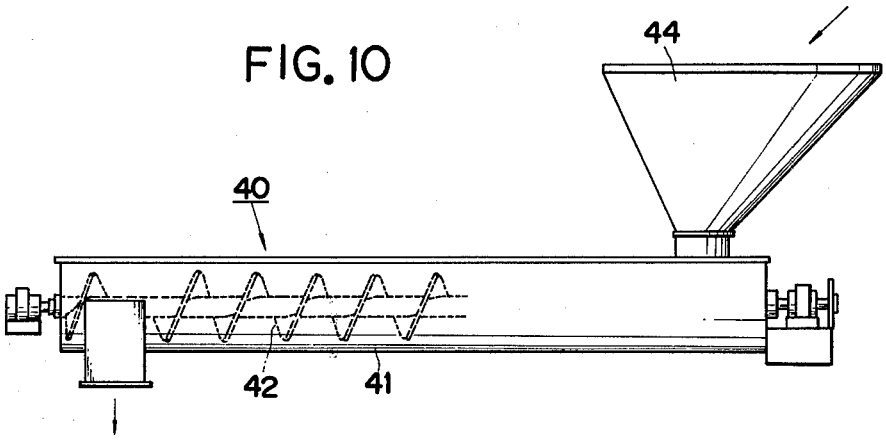
FIGS. 10 and 11 are schematic side view and an end view of the screw feeder, respectively.
Figure 11:
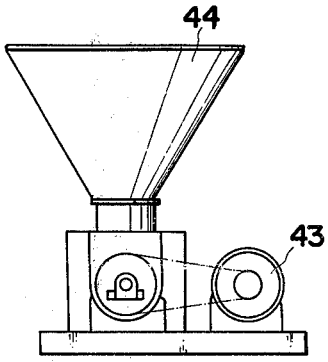

FIGS. 9 through 11 show another example of the means of intermittently feeding the concrete material. Referring to the figures, a screw feeder 40 has a cylinder 41 and a screw 42 rotatably disposed in the cylinder 41. A motor 43 rotates the screw 42. The screw feeder 40 is installed on the ground surface near the vertical shaft A, and the free end of the screw feeder 40 extends to a position above the vertical shaft A and is airtightly connected to the top portion of the flexible hose 3 of rubber or synthetic resin for suspending the hose 3 therefrom. A hopper 44 is provided at the opposite end of the screw feeder 40.

In operation, the concrete material is supplied onto the hopper 44 from a truck mixer vehicle or a conveyor, and the concrete material can be fed onto the flexible hose 3 in an airtight fashion by the screw 42 of the screw feeder 40. Accordingly, if the screw 42 is intermittently rotated, the concrete material can be intermittently fed onto the flexible hose 3. The concrete material thus intermittently fed to the flexible hose 3 drops comparatively slowly while expanding the flexible hose 3, so that no separation of the ingredients of the concrete occurs.

Thus, the screw feeder of FIGS. 9 through 11 ensures intermittent feeding of concrete material toward the flexible hose which extends downwardly through a high head, while maintaining airtightness of the flexible hose. Furthermore, the screw feeder effects the horizontal feeding of the concrete material, so that the supply of the concrete material can be safely carried out near the inner surface of vertical shafts. Besides, the opening for receiving concrete material is clearly separated from the opening for sending out the concrete material, so that works above the vertical shaft are not disturbed by the placing of concrete thereto, and the inside space of the vertical shaft can be also effectively used without disturbances.

Obvioulsy, many modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A process for placing concrete through a high head, comprising the steps of:

extending a flexible collapsible hose downward from a feeding level at the top of said high head to a discharge level near the bottom of said high head;

introducing a slug of liquid material into the top end of said hose at said feeding level;

airtightly closing the top end of said hose immediately after introduction of said slug therein to prevent air from entering into said hose as said slug of liquid material passes downward to said discharge level for flattening said hose;

thereafter intermittently feeding discrete portions of wet concrete material down through said hose at intervals;

and airtightly closing the top end of said hose immediately after feeding each discrete portion of the concrete material so that said hose remains flattened between adjacent portions of the concrete material, thereby controlling the rate of descent of the concrete portions and maintaining the coherency of each portion.

* * * * *